US005526461A

United States Patent [19]

Grieder et al.

[11] Patent Number: 5,526,461

[45] Date of Patent: Jun. 11, 1996

[54] EVAPORATION VESSEL AND ELECTRODE ARRANGEMENT FOR AN ELECTRODE EVAPORATOR HAVING A DUMMY ELECTRODE

[75] Inventors: Heiner Grieder, Füllinsdorf; Marcel Mössner, Reinach, both of Switzerland

[73] Assignee: Condair AG, Munchenstein, Switzerland

[21] Appl. No.: 215,691

[22] Filed: Mar. 22, 1994

[30] Foreign Application Priority Data

Mar. 23, 1993 [CH] Switzerland ..... 879/93

[51] Int. Cl.[6] ..... F22B 1/30; H05B 3/60

[52] U.S. Cl. ..... 392/325; 392/331; 392/338

[58] Field of Search ..... 392/325, 337, 392/338, 336, 334, 329, 331, 322, 323, 313, 311; 204/280, 286, 287, 411, 412

[56] References Cited

U.S. PATENT DOCUMENTS 1,476,080 12/1923 Kaelin .

FOREIGN PATENT DOCUMENTS 1166296 4/1984 Canada .
2300292 9/1976 France .
306280 6/1918 Germany .
395142 3/1938 Germany .
663286 12/1951 United Kingdom .

*Primary Examiner*—John A. Jeffery
*Attorney, Agent, or Firm*—Leydig, Voit & Mayer

[57] ABSTRACT

A refinement of an evaporation vessel and electrode arrangement allows a large range of different apparatus types to be provided, of variable construction, using a small number of different components. For this purpose, an arrangement of a plurality of bushings (16.1, 16.2) is provided in the wall of the evaporation vessel (2, 6, 10), in which bushings (16.1, 16.2) electrodes (20) can be held by a plug-in part (18). The plug-in part (18) is provided with an automatic latching device (38, 40) which holds it firmly after simple insertion into one of the bushings (16.1, 16.2) and which can be released again by hand, if required, in order to remove the plug-in part. Electrodes can thus be installed at various positions and in different orientations in a simple manner, depending on the desired design of the electrode evaporator. It is furthermore proposed to include in the electrode arrangement a dummy electrode which is electrically not connected or is connected to a neutral conductor. Using such a dummy electrode, the behavior of the electric field can additionally be controlled, so that the other (active) electrodes require less matching to different apparatus designs, or do not need any matching at all.

25 Claims, 3 Drawing Sheets

FIG. 1
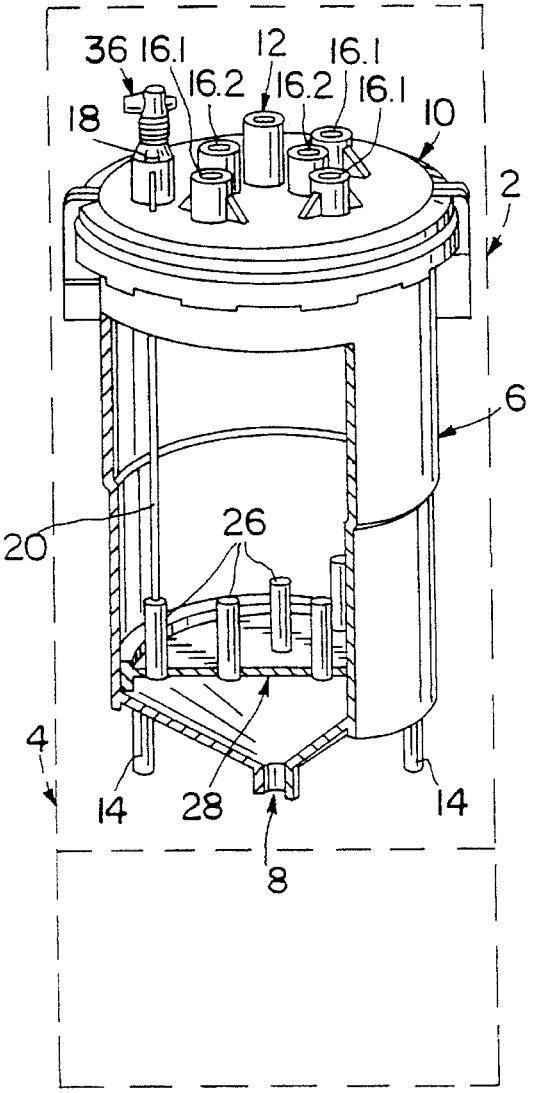
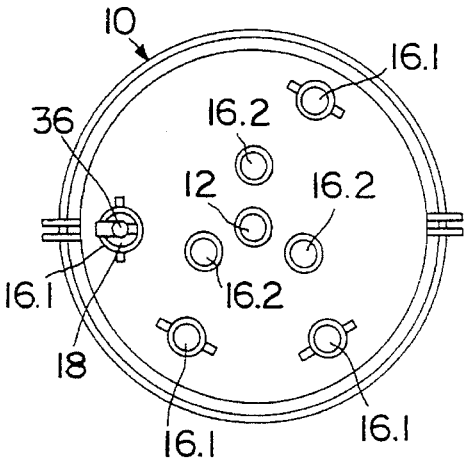
FIG. 2
FIG. 4
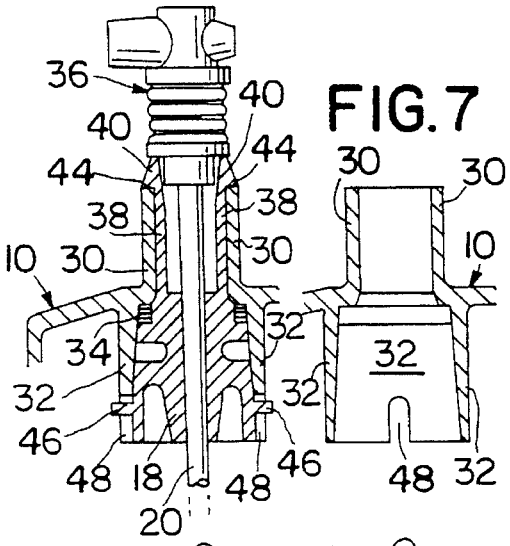
FIG. 7
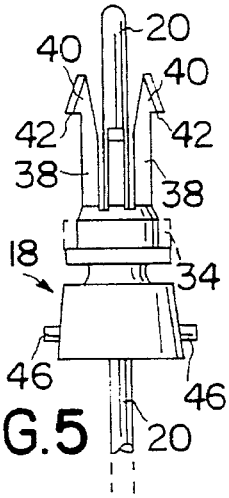
FIG. 5
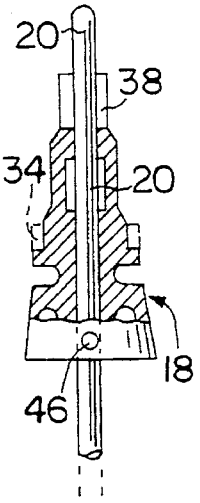
FIG. 8
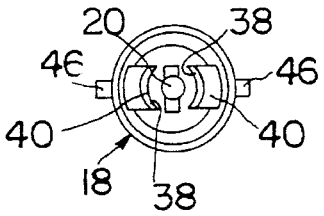
FIG. 6

FIG. 13
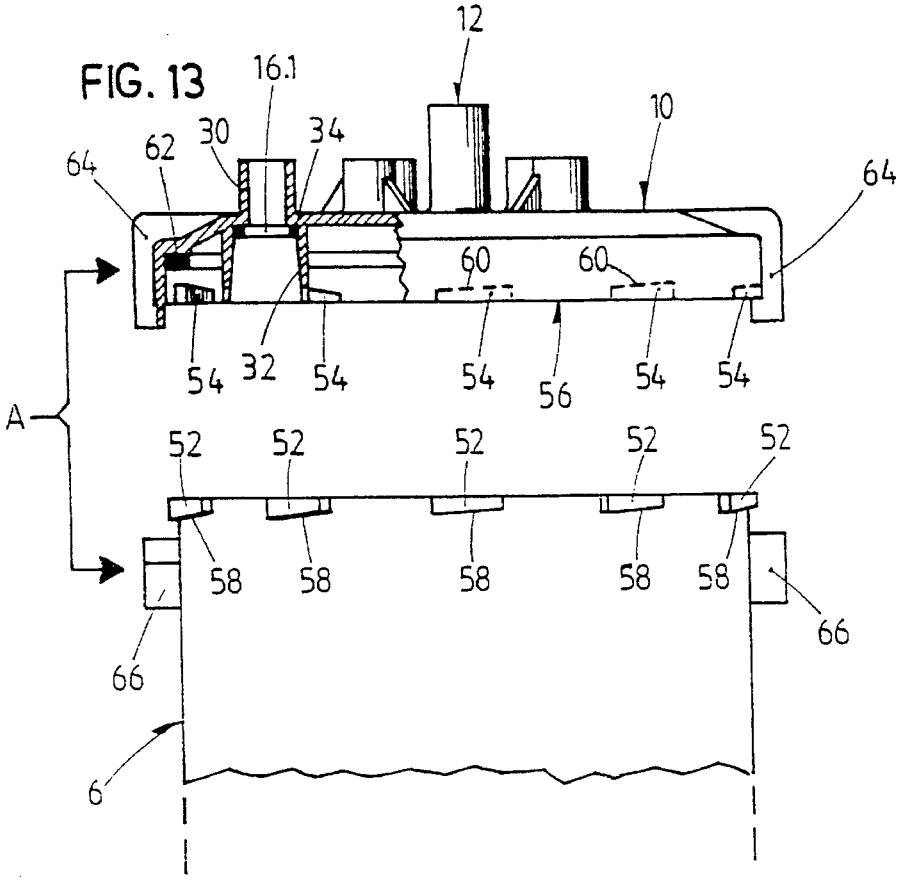
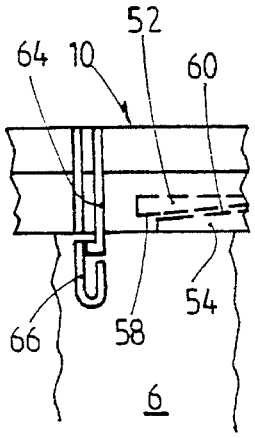
FIG. 15
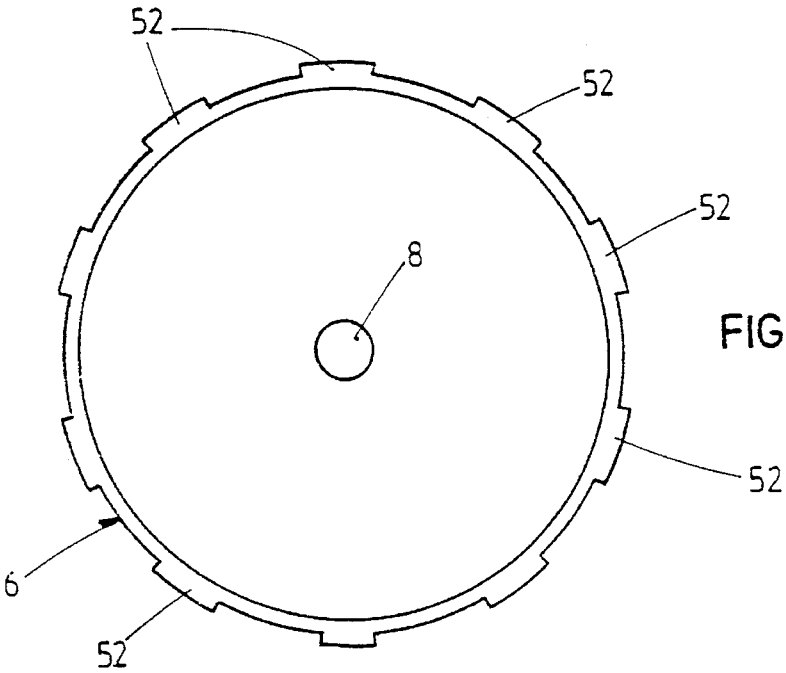
FIG. 14

EVAPORATION VESSEL AND ELECTRODE ARRANGEMENT FOR AN ELECTRODE EVAPORATOR HAVING A DUMMY ELECTRODE

BACKGROUND OF THE INVENTION

The invention relates to an electrode arrangement for an evaporation vessel of an electrode evaporator and to an evaporation vessel for an electrode evaporator, having an electrode arrangement which comprises at least two electrodes which are held in the vessel wall and can be electrically connected from outside the evaporation vessel.

Electrode evaporators are known as vapour generators, in the case of which a single-phase or multi-phase alternating current is passed through the water via two or more electrodes and the water itself is used as the heating resistance for generating the heat which is required for evaporation. They are mainly used in air humidifiers for ventilation and air-conditioning systems or for direct room air humidification.

The apparatuses and, in particular, the evaporation vessels must be designed very differently (in particular with respect to the number, shape and arrangement of the electrodes) depending on the required power and as a function of the properties of the electrical mains, which differ very much depending on the point of use and the geographical region (different rate of voltages, number of phases etc.). In the case of the known electrode evaporators, on the one hand, for the manufacturer, this means that he must produce a large number of different apparatus types and, on the other hand, for the wholesaler and retailer, it means that he must keep a large number of different apparatuses and spare parts.

SUMMARY OF THE INVENTION

It is thus an object of the present invention to propose a design refinement of an evaporation vessel and electrodes which allows a large range of different apparatus types to be provided, in a variable construction, using a small number of different components.

The behaviour of the electric field can be influenced, as the person skilled in the art will see immediately, by insertion of a dummy electrode, that is to say of a part which is electrically conductive but is not connected electrically or is connected to a neutral conductor, into the electrode arrangement. By suitable selection of the size and shape of the dummy electrode, the operation of the electric field can be matched to different requirements, so that the other (active) electrodes require less matching or do not need any matching at all. Only a few electrode types are thus required to cover a wide range of apparatuses.

For symmetry reasons, as a rule it will be expedient to arrange the dummy electrode in the centre of the electrode arrangement, that is to say more precisely, coaxially with respect to the central axis of symmetry of the arrangement which is formed by the other electrodes. A hollow cylinder is proposed as a simple, advantageous shape for the dummy electrode; however, any desired shapes, even complex shapes, are in principle conceivable, depending on the application.

In addition, using a dummy electrode, a further problem, which is also known to the person skilled in the art under the term "leakage current", can be solved in a simple manner. Specifically, if the dummy electrode is arranged such that, for example with its lower section, it electrically screens the region in the vicinity of the water inlet and outlet, the formation of electrical potential differences in this region is thus prevented, which otherwise can generate an undesirable and dangerous electrical current in the emerging water when (electrically conductive) water is allowed to flow out.

A further way of making a wide range of configurations possible using a small number of electrode types is achieved according to the invention as follows: a plurality of bushings are provided in the wall of the evaporation vessel, in which bushings an electrode can be held by means of a special plug-in part. This allows electrodes to be arranged at different positions and in different orientations, so that different arrangements can be implemented using the same electrode type. The plug-in part is provided with a latching device which, on the one hand, holds the plug-in part, which is inserted into a bushing, such that it automatically latches and, on the other hand, can be released again by hand without any tools if it is intended to remove the plug-in part or the electrode again.

This design refinement furthermore makes it possible for the electrodes to be installed and removed quickly and represents a considerable simplification in comparison with the conventional type of construction, in the case of which the electrodes are firmly inserted in the evaporation vessel, are frequently injection-moulded directly in the vessel wall or are then screwed tight.

The simplicity of the installation and removal of the electrodes achieved in this way, as well as the advantages which result in cleaning and servicing, are extremely advantageous, particularly from the ecological viewpoint, since electrodes which have become unuseable as a result of mineral deposits after a specific life can now be replaced independently of the evaporation vessel, and can possibly even be cleaned and reused. In comparison with conventional apparatuses, this means less waste and a considerable reduction in the environmental contamination since, until now, once the life had expired, that is to say as soon as the mineral deposits are excessive, the entire evaporation vessel must be replaced together with the electrodes since removal of the electrodes is either completely impossible or would then be much too costly.

During assembly of an evaporation vessel for a specific apparatus type, matching electrodes are installed in a suitable position and orientation by means of plug-in parts which are inserted into suitably selected bushings. A certain amount of variability is in principle achieved in this case if only one of the electrodes can be installed in this way however, in a preferred embodiment, all the electrodes are held in one or more of the bushings by means of the said plug-in parts. Unused bushings can be sealed using additional plug-in parts.

As already mentioned, different rotation orientations can be provided for the same electrode, for example a) bent towards the vessel wall and b) away from it. Interacting positioning means are expediently constructed on the plug-in part and on the evaporation vessel in order to define one or more rotation orientations of the electrode or the axial alignment of the plug-in part in the bushing. Such positioning means can, for example, comprise a special shape of the cross-sectional contour of the bushing and plug-in part or can also be implemented using positioning studs and corresponding recesses for accommodating the positioning studs in the other part.

Very frequently, further functional parts, for example sensors for the water level and the like, must be arranged in the interior of the evaporation vessel as well as the electrodes. These further functional parts are also advantageously held in one of the bushings by means of a plug-in part.

BRIEF DESCRIPTION OF THE DRAWINGS

An exemplary embodiment is described in the following text in order to explain the invention in more detail, with reference to the attached drawings, in which:

FIG. 1 shows an evaporation vessel according to the invention, in a perspective, partially cut-away illustration, FIG. 2 shows a plan view of the evaporation vessel in FIG. 1, FIG. 4 shows a vertical section of a plug-in part, which is inserted into a bushing in the cover of the evaporation vessel, together with a plug for the electrical connection of the electrode, FIG. 5 shows a side view of the plug-in part in FIG. 4, FIG. 6 shows a plan view of the plug-in part in FIG. 5, FIG. 7 shows a vertical section of a bushing, which section is rotated through 90° with respect to FIG. 4, FIG. 8 shows a partially cut-away side view of the plug-in part, rotated through 90° with respect to FIG. 5, FIG. 9, FIG. 10, FIG. 11 and FIG. 12 show different possible electrode arrangements in a schematic illustration, viewed from above, FIG. 13 shows a preferred embodiment of the connection of the cover and lower part of the evaporation vessel, using a side view of the lower part and the cover separated therefrom, FIG. 14 shows a plan view of the lower part of the evaporation vessel, and FIG. 15 shows a partial side view of the closed evaporation vessel, viewed from direction A in FIG. 13.

DESCRIPTION OF PREFERRED EMBODIMENTS

Figure 3:
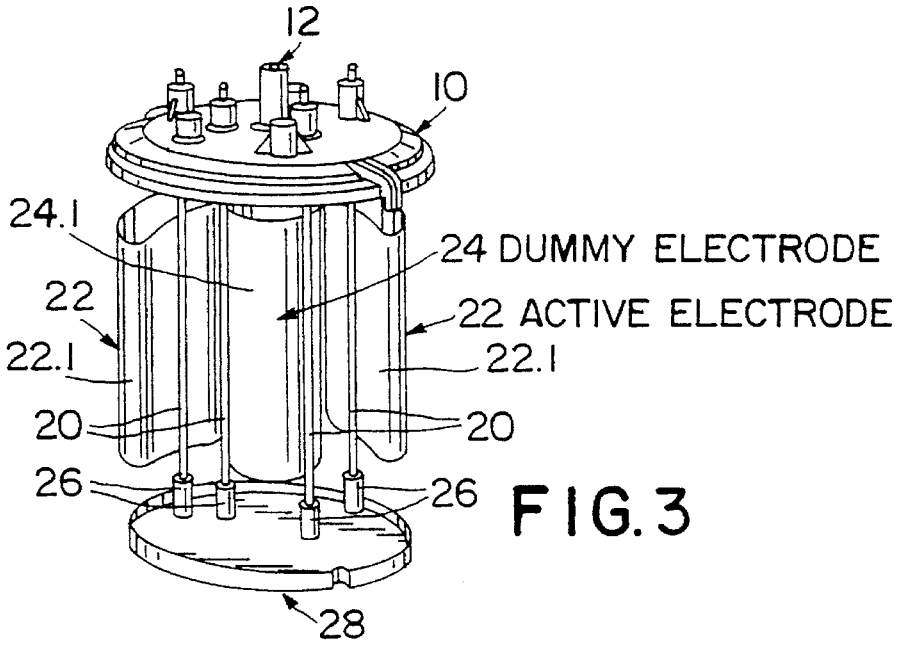
FIG. 3 shows, in a perspective illustration, the cover of the evaporation vessel having two active electrodes, which are installed therein, and one dummy electrode, together with a sieve having holding elements for supporting the electrodes in their lower region.

FIGS. 1, 2 and 13 show the evaporation vessel which is designated by 2 in its totality. It is normally located in a housing 4 (which is indicated by dashed lines in FIG. 1) of an air humidifier. Those details of such an apparatus, such as the water connection, vapour distributor, electronic controller etc., which are not essential in the present context and are known to the person skilled in the art are not illustrated. The evaporation vessel 2 consists of a lower part 6, in whose base a water inlet and outlet 8 is arranged, and of a cover 10 having a vapour outlet 12. Supporting feet 14 which are integrally formed on the lower part and on which the lower part can be erected in a free-standing manner during installation or servicing tasks can furthermore be seen.

A number of bushings, seven altogether, are constructed in the cover 10, four of which, which are designated by 16.1, are arranged relatively close to the edge and three, which are designated by 16.2, are arranged relatively close to the centre of the cover. Plug-in parts 18 can be inserted into these bushings 16.1 and 16.2 respectively, by means of which plug-in parts 18 electrodes can be held in the cover 10, as is described in more detail below.

For better clarity, the illustrations in FIGS. 1 and 2 show only a single plug-in part 18 inserted in one of the bushings 16.1, which plug-in part 18 carries a rod 20, which is part of an electrode. An arrangement of three electrodes can be seen in FIG. 3, consisting of two identical electrodes 22 which are "real" in the normal sense, that is to say are connected to a supply voltage in operation, and of an electrode 24 which is designed as a dummy electrode. A further electrode 22, which would be arranged towards the observer, is omitted in the figure (cf. FIG. 11). As has already been described in general above, the dummy electrode 24 is not connected to a supply voltage but is held in an electrically insulated manner in the wall of the evaporation vessel 2, or is possibly connected to a neutral conductor. It is used to a certain extent passively in order to influence the electric field which is generated by the active electrodes 22.

In the case of the exemplary embodiment shown here, each electrode 22 consists of a rod 20 and an electrode body 22.1 attached thereto, and the electrode 24 consists of two rods 20 and an electrode body 24.1 which is attached to these rods. Both the rods 20 and the electrode bodies 22.1 and 24.1 respectively are manufactured from an electrically conductive material, preferably metal. All the electrodes are held in the cover 10 by means of plug-in parts which are in each case attached to one of the rods 20, to be precise the electrodes 22 in bushings 16.1 and the dummy electrode 24 in bushings 16.2.

As can be seen in FIGS. 1 and 3, retaining elements 26 can be provided for supplementary stabilization of the electrodes, which retaining elements 26 are fitted on a sieve 28, for example being integrally formed, which sieve 28 is normally present anyway and is arranged in the evaporation vessel at the bottom. In the case of the exemplary embodiment, the retaining elements 26 are constructed as sleeves into which the lower ends of the rods 20 are inserted.

The details of the bushing 16.1 or 16.2 respectively and the plug-in part 18 can best be seen in FIGS. 5 to 8. The bushings 16.1, 16.2 are essentially constructed identically so that the same plug-in part can be inserted into both. They have a circular cross-section and are surrounded by annular guide flanges 30 and 32 which support the plug-in part 18 at the sides. The contour of the plug-in part 18 is matched, in a tightly seating manner, to the bushing 16.1 or 16.2 respectively and the guide flanges 30, 32. A sealing ring is designated by 34. If an electrode is intended to be held by means of a plug-in part 18, then said electrode is firmly attached to the plug-in part. In the case of the exemplary embodiment which is shown, the rod 20 for this purpose extends through a central hole in the plug-in part 18; the upper end of the rod can thus at the same time be used as an electrical connecting pin for a connecting plug 36.

The plug-in part 18 has two elastically flexible tongues 38, which are provided at their free end with a latching stud 40, as a latching device which can hold the plug-in part 18 in one of the bushings 16.1, 16.2 such that it latches automatically. The latching stud 40 is formed such that it tapers in the shape of a wedge in the insertion direction and has a latching projection 42 which engages behind a latching edge 44, in this case the edge of the guide flange 30, when the plug-in part is inserted. If a plug-in part 18 is moved into one of the bushings 16.1, 16,2, then the wedge surfaces of the tongues 38 run onto the edge of the bushing and in consequence are bent so far inwards that the plug-in part can be moved further into its final position. The length of the tongues 38 is selected such that the latching stud 40 becomes free again precisely in the final position, is thus forced outwards by the elasticity of the tongues 38 and engages behind the latching edge 44. In order to remove the plug-in part from the bushing, the projecting ends of the two tongues 38 can be pressed towards one another, for example using two fingers, until the latch is released and the plug-in part can be removed. As can be seen in FIG. 4, furthermore, the connecting plug 36 can advantageously be Used for the purpose of securing the tongues 38 in their latching orientation.

According to a preferred embodiment, positioning studs 46 are provided on the plug-in part 18 and corresponding recesses 48, in the form of slots, are provided in the guide flange 32. The positioning studs 46 and recesses 48 form interacting positioning means which ensure that the plug-in part 18 can be inserted into one of the bushings 16.1, 16,2 only in specific axial alignments. In the design which is illustrated in FIGS. 4 to 8, for example, the plug-in part 18 can be inserted in only two orientations, which differ by rotation through 180° about the main axis of the plug-in part.

Figure 9:
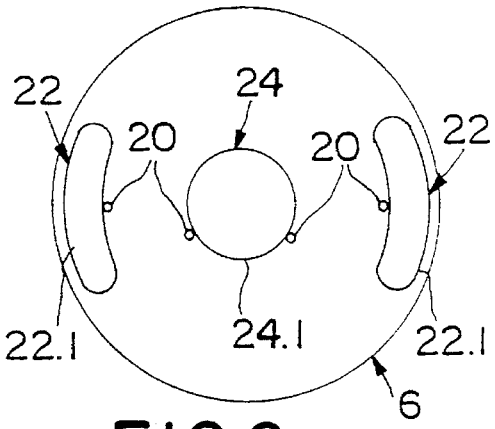
Figure 11:
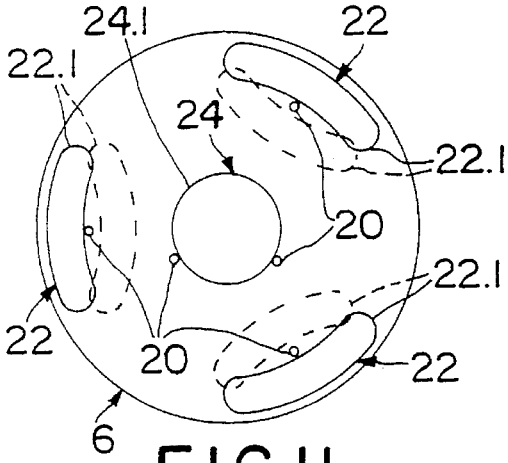
Figure 10:
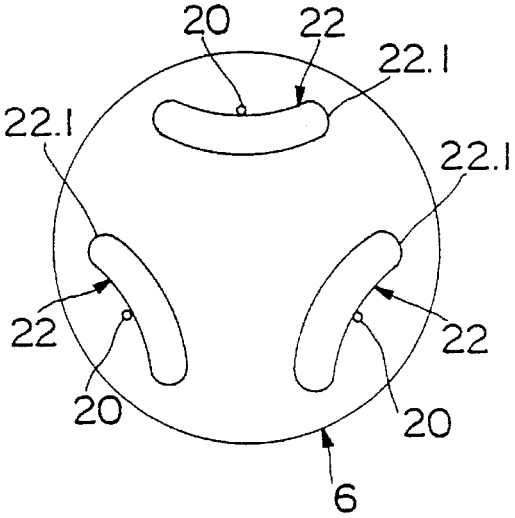
Figure 12:
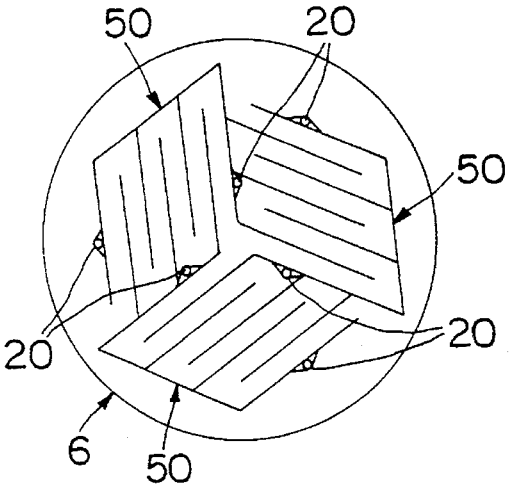

In order to illustrate the wide possibilities which the invention offers for implementing different electrode arrangements in the same evaporation vessel using only a small number of electrode types, four examples are given in FIGS. 9 to 12. The position of the rods 20 in this case corresponds in each case to one position—which can best be seen in FIG. 2—of the bushings 16.1 and 16.2 respectively. The arrangement in FIG. 9 is used for two-phase alternating current and comprises two electrodes 22 and a dummy electrode 24, both of the type which has already been described further above with reference to FIG. 3. The arrangement in FIG. 10 is suitable for three-phase alternating current, it consists of three electrodes 22 which, in contrast to FIG. 9, are aligned bent inwards. FIG. 11 shows the arrangement in FIG. 10, supplemented by a dummy electrode 24. Two possible orientations of the electrodes 22 are indicated here, one bent inwards and one bent outwards. The arrangement can be matched to different vapour powers by suitable selection of the orientation of the electrodes. An arrangement having totally different electrodes is illustrated, by way of a supplement, in FIG. 12. These are three large-area electrodes 50, as are used for so-called demineralized water.

In the case of a preferred embodiment of the evaporation vessel, illustrated in FIGS. 13 to 15, the connection between the lower part 6 and the cover 10 of the evaporation vessel 2 is designed in the manner of a bayonet fitting. This makes the handling during opening and closing of the vessel particularly simple since only a short rotation is necessary for this purpose, and thus simplifies, in particular, replacement of the electrodes by the user. The bayonet fitting is formed by a number of first, outwardly projecting studs 52 on the lower part 6 and a corresponding number of second, inwardly projecting studs 54 on an annular web 56 on the cover, which web 56 engages over the edge of the lower part and the first studs 52. The studs 52 and 54 have inclined surfaces 58 and 60 respectively which face one another when the cover is fitted and run in a slightly inclined manner with respect to the fitting plane so that the two parts are moved towards one another by rotating the cover relative to the lower part, until the edge of the lower part 6 is pressed against a sealing ring 62, which is inserted in the cover 10, and the fitting is firmly seated. Two ribs 64 and 66 respectively, which are integrally formed on the side, on the web 56 and on the lower part 6 respectively form an additional stop for the closing rotation.

What is claimed is:

1. An electrode arrangement for an evaporation vessel of an electrode evaporator, comprising one or more real electrodes for connection to a power supply and an ungrounded dummy electrode electrically isolated from the power supply and walls of the positioning vessel and positioned so as to screen an electric field generated by the real electrodes in a vicinity of a water inlet and outlet of the evaporation vessel.

2. An electrode arrangement according to claim 1 wherein the dummy electrode is arranged essentially coaxially with respect to a central axis of symmetry of the real electrodes.

3. An electrode arrangement according to claim 1 wherein the dummy electrode has a substantially cylindrical outer periphery.

4. An electrode arrangement according to claim 1 wherein the dummy electrode comprises an electrically conducting rod and a hollow, electrically conducting body extending along and attached to a side surface of the rod and electrically connected to the rod.

5. An electrode arrangement according to claim 4 wherein the electrically conducting body has a cylindrical outer periphery.

6. An electrode arrangement according to claim 4 wherein the electrically conducting body is mounted on the rod.

7. An electrode arrangement according to claim 6 wherein the electrically conducting body extends in a lengthwise direction of the evaporation vessel and has lengthwise ends spaced from lengthwise ends of the evaporation vessel.

8. An electrode arrangement according to claim 1 wherein each of the real electrodes comprises an electrically conducting rod and a hollow, electrically conducting body extending along and attached to a side surface of the rod and electrically connected to the rod.

9. An electrode arrangement according to claim 8 wherein the electrically conducting body of each real electrode has an arcuate peripheral surface facing the dummy electrode.

10. An electrode arrangement according to claim 9 wherein the arcuate surface is concave with respect to the dummy electrode.

11. An electrode arrangement according to claim 9 wherein the arcuate surface is convex with respect to the dummy electrode.

12. An electrode arrangement according to claim 8 wherein the rod of each real electrode has an end adapted for connection to a power supply.

13. An electrode arrangement according to claim 8 wherein the body of each real electrode is mounted on the rod to which it is electrically connected.

14. An evaporation vessel for an electrode evaporator comprising a container having a wall, a plurality of bushings disposed on the wall, a plurality of plug-in parts supported by the bushings, each plug-in part including a latching device attached to one of the bushings such that the plug-in parts can automatically be latched and released again, without any tools, for removal of the plug-in parts from the bushings, and a plurality of electrodes disposed in the container, and at least one of the electrodes being supported on the container wall by one of the plug-in parts inserted into one of the bushings.

15. An evaporation vessel according to claim 14 wherein the electrodes include one or more real electrodes for connection to a power supply and a dummy electrode positioned so as to influence an electric field generated by the real electrodes.

16. An evaporation vessel according to claim 14 wherein each electrode is supported by the container wall by one of the plug-in parts inserted into one of the bushings.

17. An evaporation vessel according to claim 14 wherein the bushings are arranged in such a manner that different electrode configurations can be implemented.

18. An evaporation vessel according to claim 14 comprising interacting positioning means provided on the plug-in parts and on the container for fixing the axial alignment of one of the plug-in parts in one of the bushings.

19. An evaporation vessel according to claim 14 comprising further functional parts arranged in the interior of the container and supported by the container wall by at least one of the plug-in parts inserted into one of the bushings.

20. An evaporation vessel according to claim 14 wherein the bushings are provided in an upper cover wall of the container.

21. An evaporation vessel according to claim 14 comprising a sieve disposed in a lower portion of the container and retaining elements disposed on the sieve and supporting lower end regions of the electrodes.

22. An evaporation vessel according to claim 14 comprising guide flanges extending from the container wall for lateral support of the plug-in parts.

23. An evaporation vessel according to claim 14 wherein each latching device comprises at least two tongues which are flexible in a resiliently elastic manner and which each have a free and provided with a latching stud which tapers in the shape of a wedge in an insertion direction and forms a latching projection against the insertion direction and which, in an inserted state, engages behind a corresponding latching edge on the container.

24. An evaporation vessel according to claim 14 wherein the container comprises a lower part and a cover which can be joined together in the manner of a bayonet fitting.

25. An evaporation vessel according to claim 24 wherein the lower part has a circular opening with an edge on which first studs are provided and which are distributed over a circumference of the opening and project outwards, and the cover has an annular web which engages over the opening and the first studs and has an edge on which second studs are provided and distributed over a circumference of the web and project inwards, and the first and the second studs each have inclined surfaces which interact to form a bayonet fitting.

* * * * *

UNITED STATES PATENT AND TRADEMARK OFFICE

CERTIFICATE OF CORRECTION

PATENT NO. : 5,526,461

DATED : June 11, 1996

INVENTOR(S) : Grieder et al.

It is certified that error appears in the above-indentified patent and that said Letters Patent is hereby corrected as shown below: On title page, Item 56: References Cited (U.S. Patent Documents); Insert

| | | | | |
|---|---|---|---|---|
| -- | 1,950,511 | 3/1934 | NOLL | 392/328 |
| | 3,426,141 | 2/1969 | STORCH | 392/337 |
| | 4,243,870 | 1/1981 | GRIME et al. | 392/335 |
| | 4,423,310 | 12/1983 | ZERBEL | 392/329 |
| | 1,527,762 | 2/1925 | UNLAND | 392/331 |
| | 3,931,530 | 1/1976 | DAVIS et al. | 361/3 |
| | 1,431,580 | 10/1922 | GRAETZER et al. | 392/338 --; |

Item 56: References Cited (Foreign Patent Documents); Insert

| | | | | |
|---|---|---|---|---|
| -- | 2191567 | 12/1987 | GB | 392/331 |
| | 59705 | 1/1920 | SWEDEN | 392/311 --; |

UNITED STATES PATENT AND TRADEMARK OFFICE

CERTIFICATE OF CORRECTION

PATENT NO. : 5,526,461

DATED : June 11, 1996

INVENTOR(S) : Grieder et al.

It is certified that error appears in the above-indentified patent and that said Letters Patent is hereby corrected as shown below:

Column 8; Line 1, change "and" to --end--.

Signed and Sealed this

Twelfth Day of November, 1996

*Attest:*

BRUCE LEHMAN

*Attesting Officer*

*Commissioner of Patents and Trademarks*